US009766045B2

(12) United States Patent
Fultz et al.

(10) Patent No.: US 9,766,045 B2
(45) Date of Patent: Sep. 19, 2017

(54) SECURITY DOOR

(71) Applicants: Dan L. Fultz, Louisville, KY (US); Harold L. Snook, III, Crestwood, KY (US)

(72) Inventors: Dan L. Fultz, Louisville, KY (US); Harold L. Snook, III, Crestwood, KY (US)

( * ) Notice: Subject to any disclaimer, the term of this patent is extended or adjusted under 35 U.S.C. 154(b) by 0 days.

(21) Appl. No.: 14/545,297

(22) Filed: Jan. 16, 2015

(65) Prior Publication Data

US 2015/0292841 A1 Oct. 15, 2015

Related U.S. Application Data

(60) Provisional application No. 61/964,905, filed on Jan. 16, 2014.

(51) Int. Cl.

| | |
|---|---|
| ***F41H 5/24*** | (2006.01) |
| ***F41H 5/04*** | (2006.01) |
| ***E06B 5/10*** | (2006.01) |
| ***F41H 5/22*** | (2006.01) |
| ***F41H 5/26*** | (2006.01) |
| ***E06B 1/70*** | (2006.01) |
| ***E06B 3/68*** | (2006.01) |
| *E06B 3/70* | (2006.01) |

(52) U.S. Cl.

CPC ..... *F41H 5/0407* (2013.01); *E06B 1/70* (2013.01); *E06B 3/68* (2013.01); *E06B 5/10* (2013.01); *E06B 5/106* (2013.01); *F41H 5/226* (2013.01); *F41H 5/24* (2013.01); *F41H 5/263* (2013.01); *E06B 2003/7067* (2013.01)

(58) Field of Classification Search

None

See application file for complete search history.

(56) References Cited

U.S. PATENT DOCUMENTS

| | | | | |
|---|---|---|---|---|
| 435,461 | A * | 9/1890 | Shufelt | 49/489.1 |
| 1,416,943 | A * | 5/1922 | Broughton | E06B 5/16 109/64 |
| 4,878,314 | A | 11/1989 | Blockinger | |
| 5,319,879 | A | 6/1994 | Rozycki | |
| 5,365,696 | A | 11/1994 | Ruiz | |
| 5,862,645 | A | 1/1999 | Lee | |
| 6,279,280 | B1 | 8/2001 | Plager | |
| 6,327,954 | B1 * | 12/2001 | Medlin | 89/36.08 |
| 7,100,343 | B2 | 9/2006 | France | |
| 8,154,788 | B2 | 4/2012 | Millett | |
| 8,397,450 | B1 | 3/2013 | Neal | |
| 8,844,219 | B2 | 9/2014 | Neal | |
| 2002/0046500 | A1 | 4/2002 | Hingston | |
| 2003/0200714 | A1 | 10/2003 | Minke | |
| 2004/0226231 | A1 | 11/2004 | Dlubak | |

(Continued)

FOREIGN PATENT DOCUMENTS

FR 2506446 * 11/1982

*Primary Examiner* — Stephen M Johnson

(74) *Attorney, Agent, or Firm* — Carrithers Law Office PLLC

(57) ABSTRACT

A stile and rail ballistic security door containing bullet proof materials within a metal or synthetic material frame including a plurality of window panes and thermal break means to eliminate condensation problems therein. The door contains a multi-layer exterior core providing extra strength and rigidity.

8 Claims, 18 Drawing Sheets

(56) References Cited

U.S. PATENT DOCUMENTS

| | | | |
|---|---|---|---|
| 2008/0263958 | A1 | 10/2008 | Edson |
| 2011/0262721 | A1 | 10/2011 | Albertelli |
| 2011/0314738 | A1 | 12/2011 | Harriott |
| 2014/0352240 | A1 | 12/2014 | Matta |
| 2014/0360416 | A1 | 12/2014 | Deiler |

* cited by examiner

SECURITY DOOR

REFERENCES TO RELATED APPLICATIONS

This application claims priority from U.S. Provisional Patent Application 61/964,905, filed on Jan. 16, 2014, which is incorporated by reference herein in it's entirety.

FIELD OF INVENTION

This invention relates to an aesthetic ballistic security door fabricated from wood, metal, synthetic polymers and bullet proof glass or other translucent or transparent polymers.

BACKGROUND OF INVENTION

In an increasingly violent society, homes and businesses and commercial establishments are often targets of such threats as burglary, robbery, kidnapping, vandalism and the like. Such threats not only involve damage and destruction of personal or commercial property but also to life and limb. Due to such threats, business and home owners have installed security doors which prevent entry. Conventional security doors which are bullet proof typically are solid structures or multi-layer glass. Doors which are fabricated from wood or wood laminate seldom have a plurality of windows due to problems with fogging and clarity providing the requisite visibility therethrough. Moreover, the structural strength of doors containing a plurality of windows seldom have the structural strength to withstand high pressure damage directed toward the windows or dividers. When windows are desired or required, security doors must include bullet proof windows. Unfortunately, these security doors are not particularly attractive.

Conventional doors used in office buildings, banks and the like are typically comprised of metal such as steel. Moreover, if the doors or windows contain a bullet proof glass, the glass is riveted between steel straps or panels. There are typically no air vents in order to maintain minimum insulating properties and sound reduction properties. These doors and windows tend to sweat when used to separate areas with different temperatures, for example, an outside door.

Security doors have been used for a number of years. Typically, these doors have a cage or jail door-like appearance wherein heavy steel bars stretching vertically and horizontally in front or within the door protect the doorway from forcible entry. While attempts have been made to improve the appearance of these doors, none have proved to present a very ecstatic appearance.

SUMMARY

A security door 10 comprises a frame comprising structural members selected from the group consisting of steel, metal, stainless steel, copper, bronze, aluminum, titanium, wood, graphite polymer, graphene polymer, high density polyethylene polymers, nylon, and combinations thereof. The door 10 also contains bullet resistant transparent or translucent panes comprising glass or synthetic material. Thermal break means comprising vented channels include spaced apart support members having a synthetic vapor transmission material disposed therein. The security door may include one or more dividers partitioning at least two window panes within a window or door fabricated in accordance with the instant invention.

The security door is fabricated from wood, wood laminates, fiberglass, steel, aluminum, graphite, or other metal and/or synthetic polymers together with bullet proof or bullet resistant translucent or transparent glass or polymers. The present invention relates to a method of fabrication and construction of an aesthetic glass panel security doors containing bullet proof glass within a frame including thermal break means to eliminate condensation problems. Moreover the doors are fabricated with a thermal break to eliminate condensation on the inside of the glass or door. The steel door panels may be covered with a film and/or polymer, fiberglass, wood or other laminate and may include solid wood members covering portions of the steel frame and used in combination therewith to hold bullet proof or resistant clear or translucent panels in position.

The method of fabrication provides a means for constructing aesthetically pleasing security doors for banks, government buildings, commercial offices, churches, restaurants, and even homes so that visitors are not even aware of the special security installations.

The present invention is a security door, comprising, consisting of or essentially consisting of a frame comprising structural members selected from the group comprising of steel, metal, stainless steel, copper, bronze, aluminum, titanium, wood, graphite polymer, graphene polymer, high density polyethylene polymers, nylon, and combinations thereof, and bullet resistant transparent or translucent panes comprising glass or synthetic material.

The frame includes at least a multi-layer exterior core, an interior core, an interior bullet proof grid plate, a window pane divider grid, and an exterior flat grid plate which holds the window panes within the window pane divider which serve to dissipate force, absorb energy and act as a thermal break. A preferred embodiment of the multi-layer exterior core includes at least four flat frame members including an exterior muntin divide, an exterior veneer, and exterior wood core, and an exterior steel core flat grid bonded to one another. The four frame members each comprise two vertical and two horizontal bands connected at four corners thus forming four rectangular bands. A first T-shaped cavity is formed by the outer marginal edges of the four rectangular bands, and a second T-shaped cavity is formed by the inner marginal edges of the four rectangular bands. A first T-shaped rectangular band is bonded into and around the first T-shaped cavity, and a second T-shaped rectangular band is bonded into and around the second T-shaped cavity.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
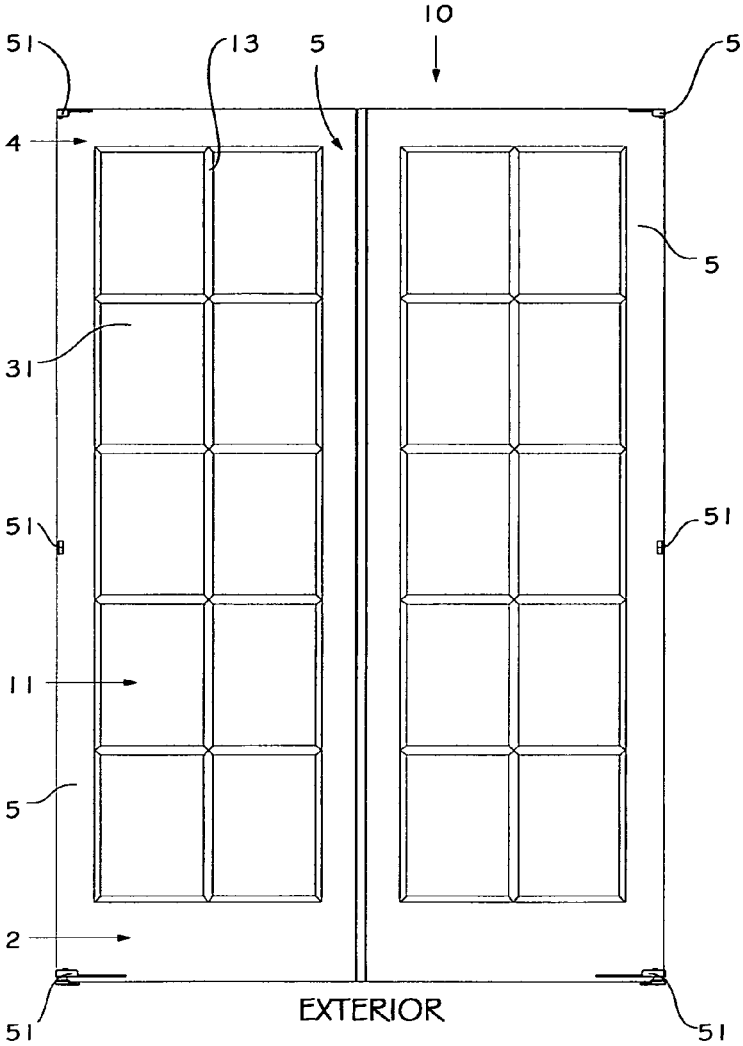
FIG. 1 is a front elevated view of a security door of the present invention.

As shown in Figures, a security door 10 comprises a frame comprising structural members selected from the group consisting of steel, metal, stainless steel, copper, bronze, aluminum, titanium, wood, graphite polymer, graphene polymer, high density polyethylene polymers, nylon, and combinations thereof. The door 10 also contains bullet resistant transparent or translucent panes comprising glass or synthetic material. Thermal break means comprising vented channels include spaced apart support members having a synthetic vapor transmission material disposed therein. The security door may include one or more dividers partitioning at least two window panes within a window or door fabricated in accordance with the instant invention.

The present invention provides a method of fabrication stile and rail security doors 10 which are built with frame and panel construction. The stiles 5 comprise vertical boards that run the full height of a door and compose its right and left edges. The hinges 51 are mounted to the fixed side (known as the "hanging stile"), and the latch assembly 7 including the handle, lock, bolt, and/or latch are mounted on the swinging side (known as the "latch stile"). The rails 9 comprise horizontal boards at the top, bottom, and optionally in the middle of a door that join the two stiles and split the door into two or more rows of panels. The "top rail" and "bottom rail" sometimes referred to as the "kick rail" joins the stiles. A middle rail may optionally be disposed at about the height of the bolt providing a "lock rail", and/or other middle rails are commonly known as "cross rails" may be used as well. It is also contemplated that mullions defining smaller optional vertical boards that run between two rails and split the door into two or more columns of panels may be used providing vertical members in the doors or windows. The preferred embodiment showing in the figures include a plurality of muntin which are optional vertical members that divide the door into smaller panels. Panels 11 of a selected material such as metal, polymer, glass, or combinations thereof fill the space between the stiles, rails, and muntin. The preferred embodiment utilizes panels or an arrangement comprising layers of clear or translucent glass 31 and/or clear or translucent polymers defining lights or lites which fit into grooves in the other pieces, and help to keep the door rigid. Panels may be flat, or in raised panel designs. Can be glued in or stay as a floating panel.

Figure 2:
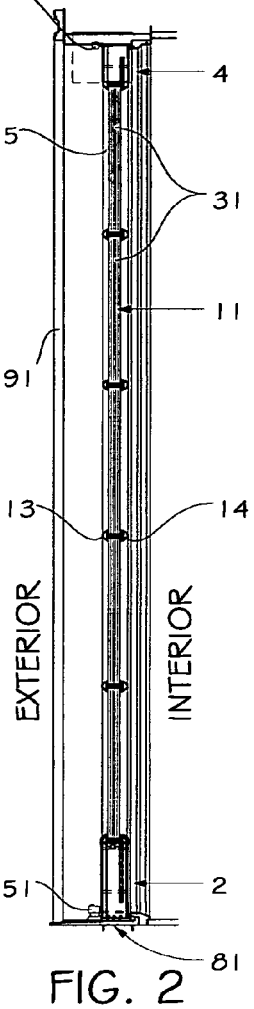
FIG. 2 is a side cross-sectional view of the door of FIG. 1 showing the top rail details including the glass panel assembly, muntin divides and bottom rail assembly.
Figure 3:
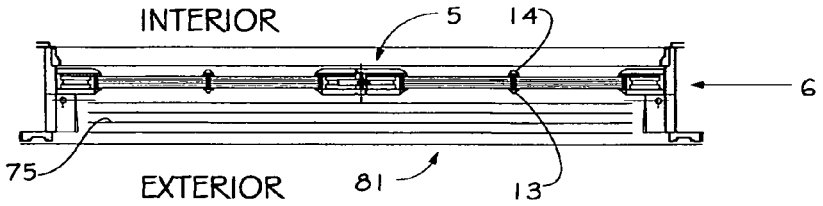
FIG. 3 is an overhead cross-sectional view of the door of FIG. 1 showing the jamb assembly and half-lap meeting stile assembly.

More particularly, as shown in FIGS. 1-3, a front view of a security door 10 is shown showing the stiles 5, rails (top rail 4 and bottom rail 2), muntin divides 13 and 14, panels 11, and hinges 51, wherein the core comprises a two piece laminated Sapele Mahogany including an exterior wood core layer and an interior wood core layer. The core can comprise various hardwood species, including laminated veneer lumber and/or stave core laminated wood consisting of either hardwood or softwood species. The exterior and interior surfaces are composed of a veneer such as a mahogany veneer, but could comprise other wood or plastic veneers or coatings. Any available wood veneer suitable for exterior exposure, high density PVC veneer, and ⅛ inch or other selected thickness exterior veneer suitable material can be used as a base for stain/clear coat finish, hand/spray paint finish, or LUMINORE type spray metallic finish. Muntin divides attach with adhesive back magnetic tape, but could be held by adhesive or magnetic tape. As shown in a preferred embodiment in FIGS. 1-3 the muntin divides comprise a Sapele Mahogany GDL muntin divide grill applied trim which is attached to steel core with a two sided adhesive tape such as 3M Company's VHB brand tape. The threshold assembly 81 includes the multi-piece overlapping plate assembly with slip resistant grooves or ridges 75 and structural stop block 82 covered with a weather-seal reglet track comprising a groove for receiving a top edge of the flashing material.

FIG. 2 is a side cross-sectional view of the door of FIG. 1 showing the top rail 4 details including the glass panel assembly 11, muntin divides 13 and bottom rail assembly 2 and FIG. 3 is an overhead cross-sectional view of the door of FIG. 1 showing the jamb assembly 6 and half-lap meeting stile assembly 5.

Figure 4:
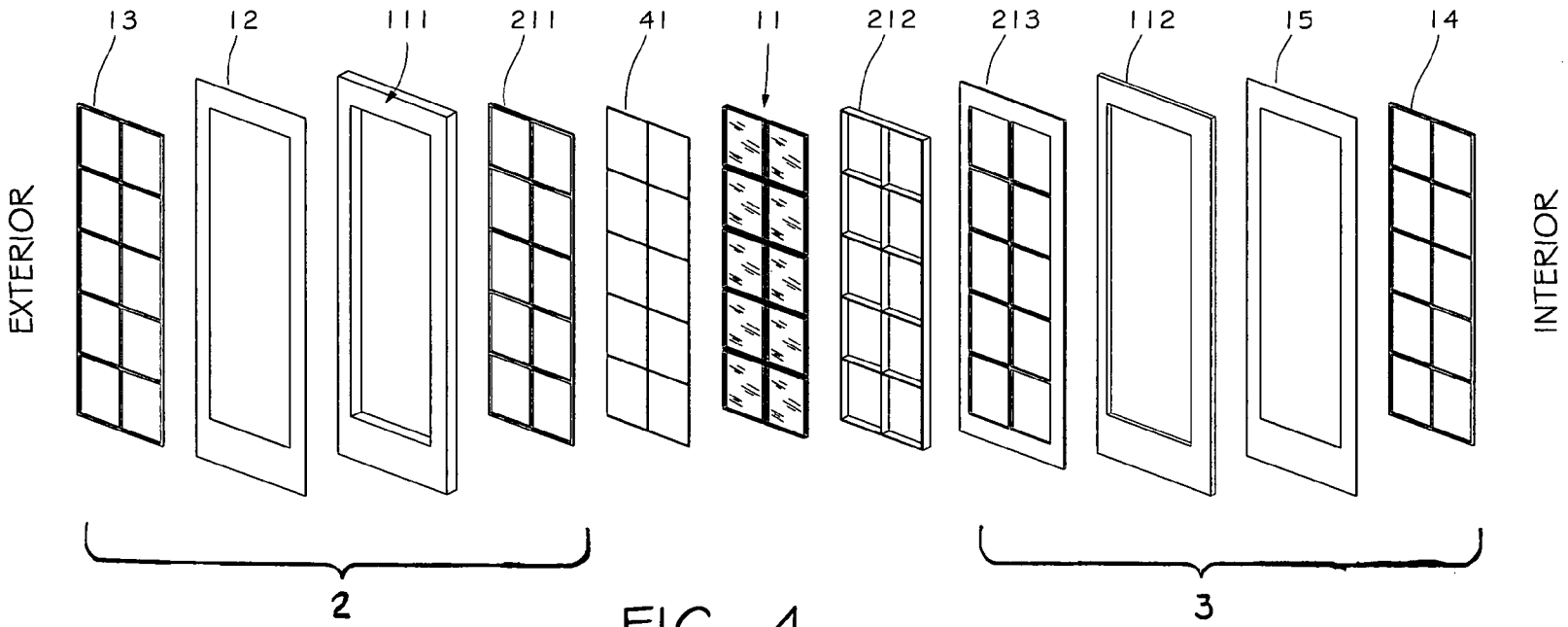
FIG. 4 is a perspective view of the door shown in FIGS. 1-3, showing an expanded door assembly showing the layered components of a one preferred embodiment of the security door including from left to right a muntin divide, an exterior veneer, an exterior wood core, a steel core exterior flat plate, a thermal break, a panel assembly including a plurality of glass and/or polymer clear or translucent sheets, a steel core middle grid, a steel core interior flat plate, an interior wood core, and interior veneer, and a muntin divide.

FIG. 4 is a perspective view of the door shown in FIGS. 1-3, showing an expanded security door assembly 10 showing the layered components of a one preferred embodiment of the security door including from left to right a multi-layer exterior core 2 including an exterior muntin divide 13, an exterior veneer 12, an exterior wood core 111, an exterior steel core flat grid 211, a thermal break material 41, a panel assembly including a plurality of glass and/or polymer clear or translucent sheets 11, a steel core middle plate layer grid having a thickness to hold the glass therein defining spacers or dividers 212, and an multi-layer interior core 3 including a steel core interior flat plate 213, an interior wood core 112, and interior veneer 15, and an interior muntin divide 14. As shown in the drawings, each of the components in FIG. 4 has an exterior side facing to the left and an interior side facing to the right.

A thermal glazing tape may optionally be disposed between the exterior steel core grid 211 and the thermal break 41 which insulates the glass preventing condensation therein or thereon. The panels of glass may include film disposed between the sheets of glass to provide the bullet proof glass and a sheet of clear polycarbonate material or other impact resistant polymer covers the glass in order to prevent shredded glass, or particles thereof and minimize the possibility of shattering glass from a projectile. It is anticipated that products such as Corning's GORILLA glass may also be incorporated in the instant invention. It should be noted that in a preferred embodiment, the middle steel grid having spacers/dividers 212 is welded to the exterior surface of the flat steel plate grid 213.

The materials of construction for the ballistic door of the instant invention are as follows:

Metal Core

The metal utilized in the preferred embodiment example is steel; however, other metals including stainless steel, titanium, aluminum, copper, brass, graphite materials, ceramic materials, and polymers and combinations thereof can be used so long as they are bullet resistant. Typically the least expensive material is steel. Of course, weight may be a consideration is some applications.

As show in the drawings, the steel core grid member 211, middle divider steel core member 212, and interior steel core panel member 213 comprise armor plate in various thickness as appropriate for specific ballistic resistance requirements. The middle grid spacer/divides 212 hold the TDL (true divided lights) glass is position. Alternate materials include stainless steel, bronze, aluminum plate material in thickness as appropriate for specific ballistic resistance, weight and/or corrosive resistant requirements.

Panels

The glass panel assembly 11 includes a plurality of glass TDL panes 31 that are ballistic resistant 'Level 5' laminated glass with a sheet of impact resistant material such as polycarbonate adhered to or disposed onto the interior face of the glass 31. Alternate materials include multiple security levels/thickness ballistic resistant laminated glass, full thickness polycarbonate clear or translucent panels, multiple security level/thickness ballistic resistant glass/polycarbonate laminate. The laminated glass typically include a polymer film between layers to prevent shattering.

Thermal break/Glazing Material

The thermal break/glazing material 41 is preferably VHB (3M VHB) 2-sided Structural glazing tape but is alternately high density, 2-sided adhesive Polyvinyl Chloride (PVC), neoprene, and/or closed cell foam glazing tapes. Preferably, no setting block 42 is used. However, high density neoprene block/strip material in thickness as desired for shimming glass any or all four sides can be used as setting blocks as desired.

As noted previously, the thermal break material may be applied in a sheet or strips to prevent condensation problems. A tape may be disposed between the thermal break 41 and exterior steel grid 211.

Hinge Assembly

A preferred embodiment as shown in the drawings includes a top hinge, a bottom hinge, and an intermediate hinges 51 comprises stainless steel offset pivot hinges wherein the hinge design load exceeds the door leaf design weight. Alternative hinges can be constructed based on the design load of the door assembly. Bronze or stainless steel 'wide swing, clear swing,' gorilla type butt hinges of 1½ pair, 2 pair, or more as required per leaf. A full height stainless steel piano type hinge may be used. Industry standard (i.e. brass, nickel, oil rubbed bronze, painted, etc.) polished, satin, gloss, matte finishes/colors/textures to compliment specific design/aesthetic requirements are acceptable.

Multi-Point Locking

Figure 8:
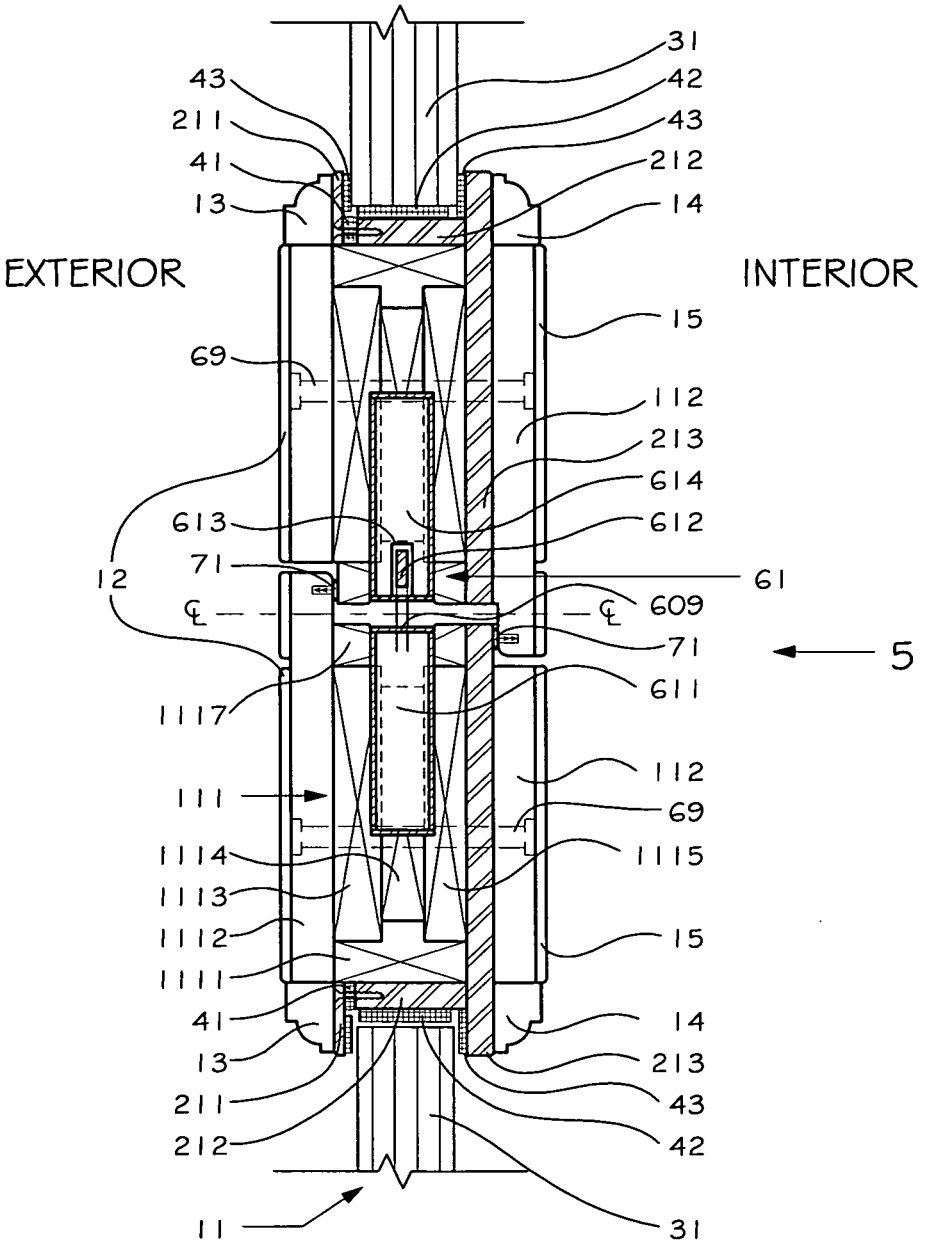
FIG. 8 is an overhead cross-sectional view at the half-lap meeting stile area of the top portions of the two doors as shown in FIG. 3, looking downward.

As shown best in FIG. 8, a preferred door contains a stainless steel 5-point semi-concealed lock/latch assembly 61 including sliding pins 612 held within the lock housing 613 which slide into an apertures in the reinforcing block 611 which is contained within the stile 111 in the other door. A reinforcing block 614 is held in the stile of the other door. Alternative locks include mortise lock, head and foot surface and/or flush bolts.

Weather Strip

Weatherstripping 71, as shown in FIGS. 5, 7, 8 and 9 consists of kerf back bulb type perimeter weather-seal, adhesive back neoprene bulb type weather-seal, and thermoseal neoprene T-back gasket seal set in a 'T' shaped reglet. Alternative materials include kerf back foam, neoprene, PVC, vinyl, or similar weather-seal gaskets, adhesive back or kerf back low density foam, silicone weather-seal, and mechanically fastened aluminum track/bulb type weather-seal assembly.

Threshold

Figure 10:
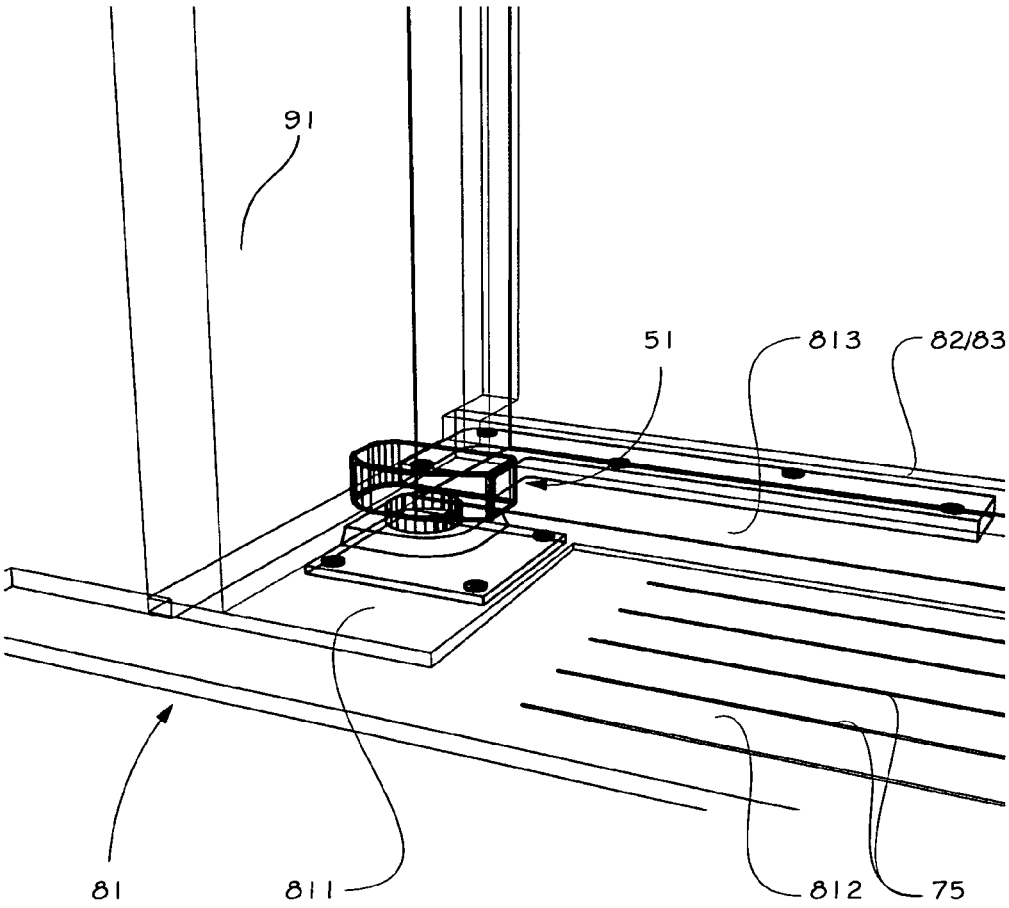
FIG. 10 is a top perspective view of the left lower hinge outside the door and threshold assembly of the security door.
Figure 11:
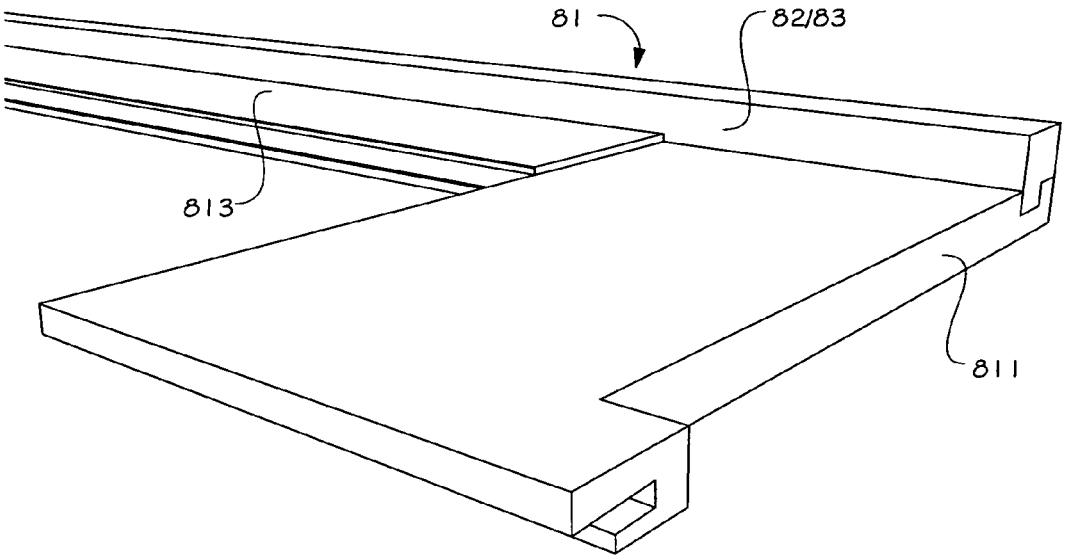
FIG. 11 is perspective view of the grooved threshold.
Figure 12:
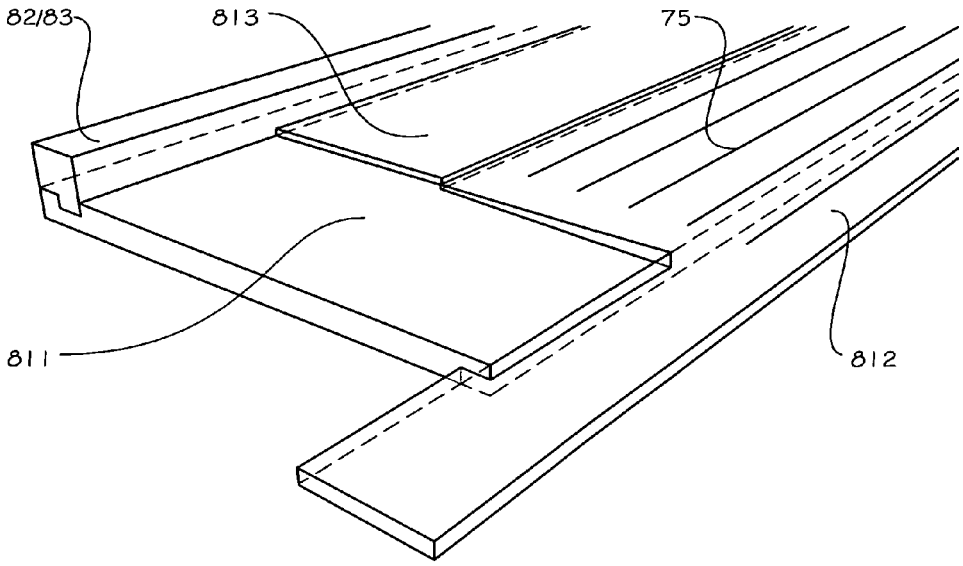
FIG. 12 is another perspective view of the grooved threshold'

The preferred threshold assembly 81 best shown in FIGS. 10-12 includes machined a stainless steel sill lugg 811, a bronze plate 812, and 813 multi-piece overlapping plate(s) with slip resistant grooves or ridges 75 on the walk surface. A stainless steel structural stop block 82 is covered by a white oak cover 83 with weather-seal reglet track serves as a door stop when closing the door.

Alternate materials for the stainless steel threshold include a single piece or multi-piece machined all bronze or all stainless steel plate assembly 81 with slip resistant grooves or ridges 75 along the walk surface and machined single piece or multi-piece all aluminum plate assembly with slip resistant grooves along walk surface. Other materials for the stop block include a metal stop block compatible with adjacent threshold material for welded or threaded fastener attachment. Hard wood can be used as a stop block cover 83.

Door Frame

The preferred door frame 91 is Sapele Mahogany milled frame with concealed fasteners while the molding 92 is preferably Sapele Mahogany head and jamb profiled trim stop block. Alternative materials for the door frame 91 include exterior suitable hardwood compatible with selected door finish veneers, welded steel frame assembly of plate, channel or tube shapes, paint or applied veneer finish, stainless steel, bronze, or aluminum built-up/welded assembly with compatible (per adjacent door) applied finish or veneer. Alternative materials for the molding 91 include structural steel stop block welded or threaded fastened to steel frame assembly with a wood or frame/trim matching head/jamb stop cover.

Figure 6:
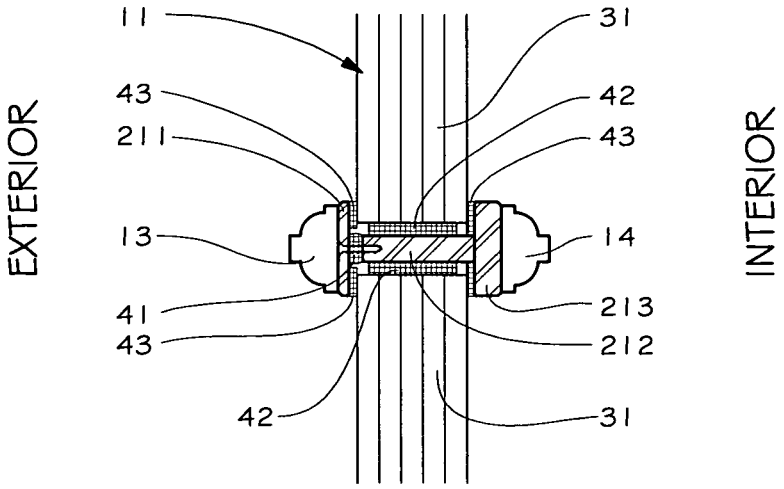
FIG. 6 is a cross-sectional view of the muntin area of the security door as shown in FIG. 2.
Figure 7:
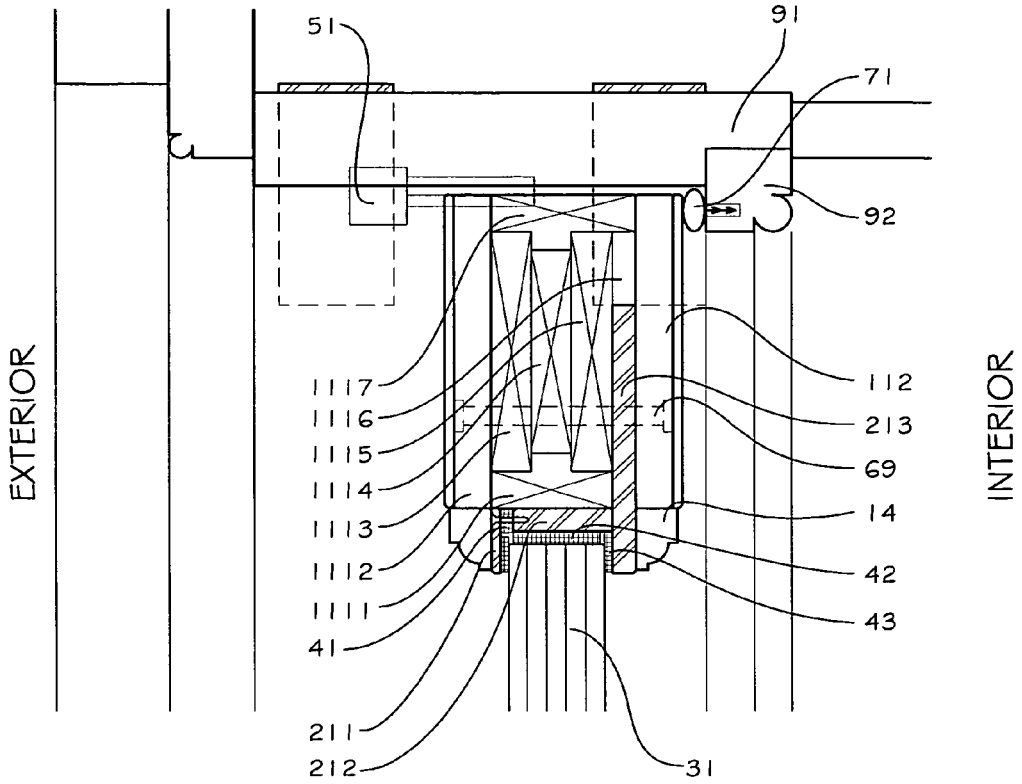
FIG. 7 is a cross-sectional side view of the top rail area of the security door as shown in FIG. 2.

FIGS. 4 and 6 show muntin divides 13 and 15 which are preferably made from Sapele Mahogany TDL (true divided lites) attached to steel core 211, 212, and 213 with 3M VHB (very high bond) 2 sided adhesive tape. Alternate attachment means include adhesive back magnetic strip tape.

Figure 5:
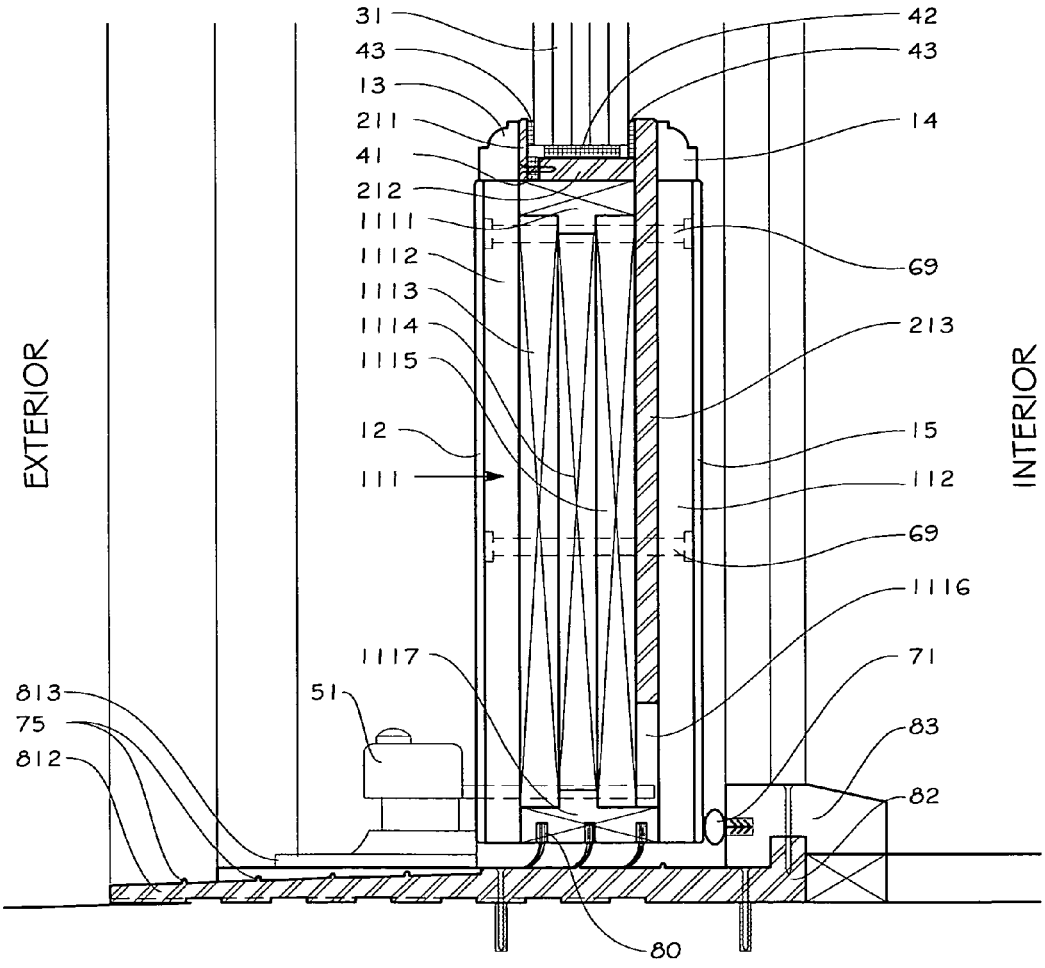
FIG. 5 is a cross-sectional view of the bottom rail area of the security door as shown in FIG. 2.

With reference to FIGS. 4, 5 and 6, the assembly of the security door 10 can be accomplished as follows:

The exterior wood or synthetic core 111 is preferably composed of multiple layers of wood or synthetic material. As seen in FIGS. 5, 7, 8 and 9, layers 1112, 1113, 1114, and 1115 are bonded together against one another in such a way that they are supported by T-shaped wood block at both the inner edges and the outer edges of each group of layers. A T-shaped block 1111 is bonded to the inner edges of the layers 1112 through 1114. Likewise, a second T-shaped block 1117 is bonded to the outer edges of the layers 1112 through 1115. The integrated laminar structure gives superior resistance to bending and or breakage in all directions for the doors.

The exterior wood core 112 is bonded to the interior side of the bullet proof flat plate 213. Then the interior wood core 112 is bonded to the exterior of flat plate 213. The inner edge of the steel panel 213 extends inwardly past the inner edge of the inner T-shaped layers 1111, 1117. The middle steel core member 212 forms a grid or "egg crate" structure providing a spacer of divider for the glass panels 31 in the panel assembly 11. The core member 212 is welded to the exterior face of steel panel 213. This inner exterior face of the steel panel 213 provides a surface against which the outer edges of the bullet proof window panes 31 will bear and are surrounded by the steel grid 212, providing resistance against forces pushing inward on the exterior surfaces of the panel assembly 11. Preferably, a glazing tape 43 is inserted between the panel assembly 11 and steel panel 213. Thus, the steel middle window pane divider grid 212 is bonded to the interior flat plate 213 inside the exterior wood core 111. Each of the individual panel assembly 11 inserted into the steel middle grid 212. A preferred embodiment includes a nonconducting thermal break material 41 around the outside edges of the glass panes 31 in the panel assembly 11 which seals the panes against the inner sides steel grid 212, as shown in FIG. 6 against temperature variations which could cause condensation problems. The thermal break 41 is bonded to the interior side of the exterior flat grid plate 211. Then the other side of the thermal break 41 is bonded to the exterior edges of the glass panes 31 and the exterior side of the steel middle grid 212. A glazing tape may be used between the The interior muntin 15 is bonded to the interior steel flat plate 213 and the exterior muntin 13 is bonded to the exterior steel grid respectively. Finally, the external veneer 12 is bonded to the external wood core 111 and the internal veneer 15 is bonded to the internal wood core 112

It should be noted that the muntin divides 13 and 15 don't divide the windows. The steel middle grid 212 divides the window panes 31 in the panel assembly from one another.

As shown in FIGS. 4-9, the frame of the security door includes an exterior wood core 111 and an interior wood core 112. Alternate materials include various hardwood species, laminated veneer lumber (LVL), or stave core laminated wood consisting of either hardwood or softwood species. Both the interior and exterior layers are covered on the outside with Sapele Mahogany veneer 12, 15. Alternate materials include any available wood veneer suitable for exterior exposure, high density PVC veneer, any ⅛"+/− thick exterior veneer suitable material as a base for stain/clear coat finish, hand/spray paint finish, or spray metallic finish.

FIGS. 4 and 6 show muntin divides 13 and 15 which are preferably made from Sapele Mahogany TDL (true divided lites) attached to steel core 211, 212, and 213 with 3M VHB (very high bond) 2 sided adhesive tape. Alternate attachment means include adhesive back magnetic strip tape.

The exterior steel core members 211, middle steel core members 212 and interior steel core members 213 comprise armor plate in various thickness as appropriate for specific ballistic resistance requirements. Three (3) layers include the exterior flat plate 211, middle grid spacer/divides 212 for TDL (true divided lights) glass, and interior flat plate 213. Alternate materials include stainless steel, bronze, aluminum plate material in thickness as appropriate for specific ballistic resistance, weight and/or corrosive resistant requirements.

FIGS. 13-17 show an alternate embodiment wherein the wood is shown by curved lines depicting the shading of the wood areas of the door.

Figure 13:
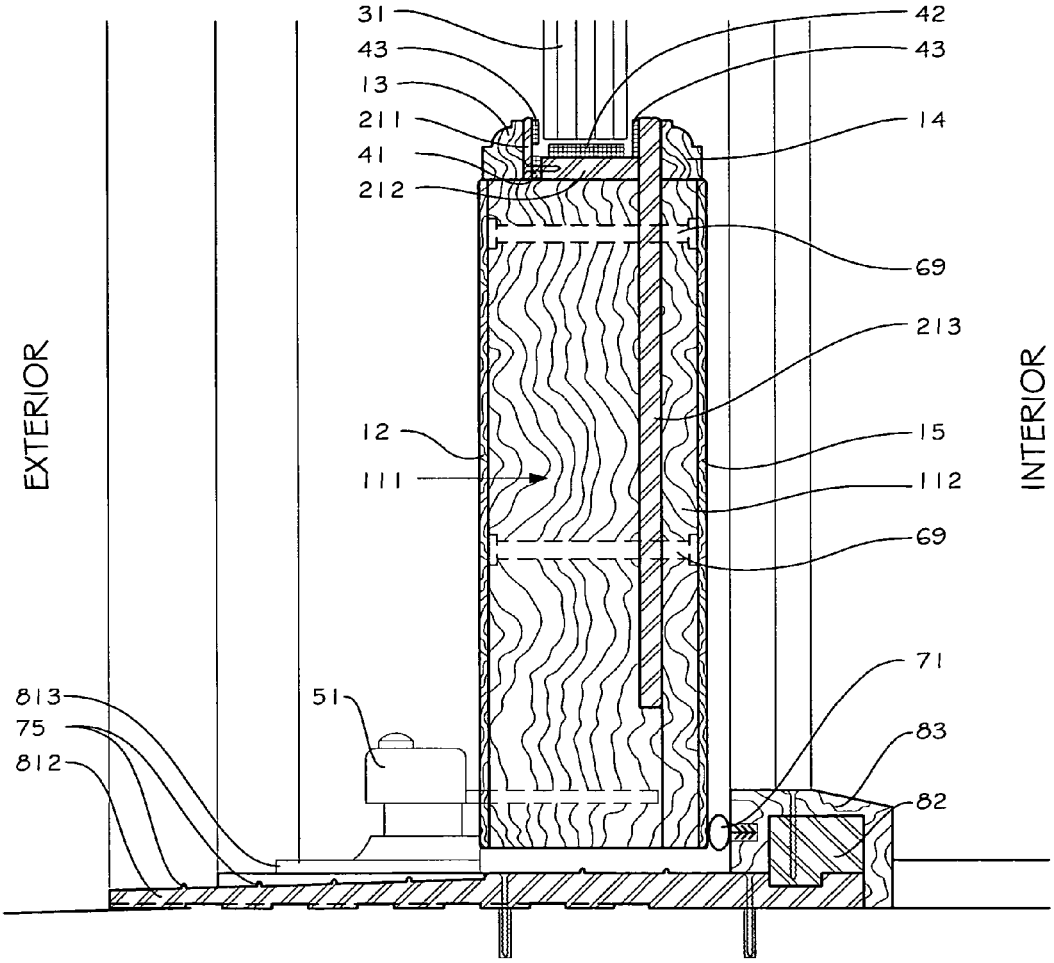
FIG. 13 is an alternate embodiment of FIG. 5 showing a cross-sectional view of the bottom rail area of the security door.

FIG. 13 shows a bottom rail design with laminated glass 31, glazing tape 43 positioned with respect to the neoprene block/stop for shimming the glass 42, and the muntin divide 13. Also shown in is the steel grid 211, steel divider member 212, and steel panel 213. The veneer 12, is shown covering the exterior wood core 111. The hinge is shown in proximity to the overlapping plates together with the stop block, stop block cover, and weather seal.

Figure 14:
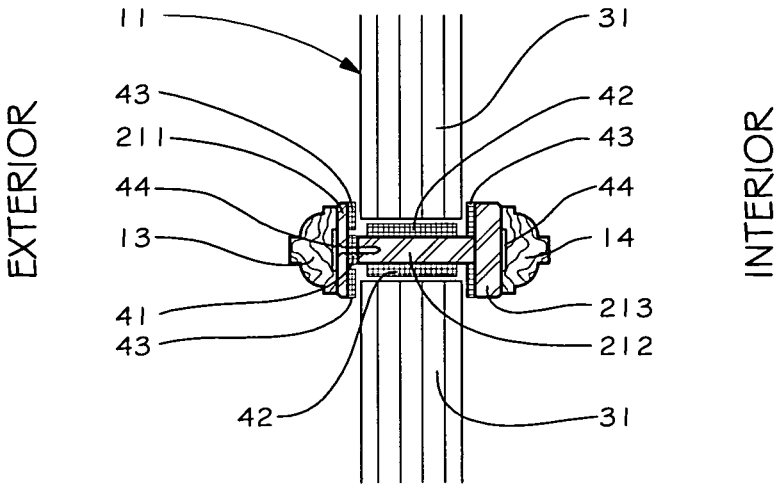
FIG. 14 is an alternate embodiment of FIG. 6 showing a muntin divide in detail with a cross-sectional view of the muntin area of the security door.

FIG. 14 shows an muntin assembly.

Figure 15:
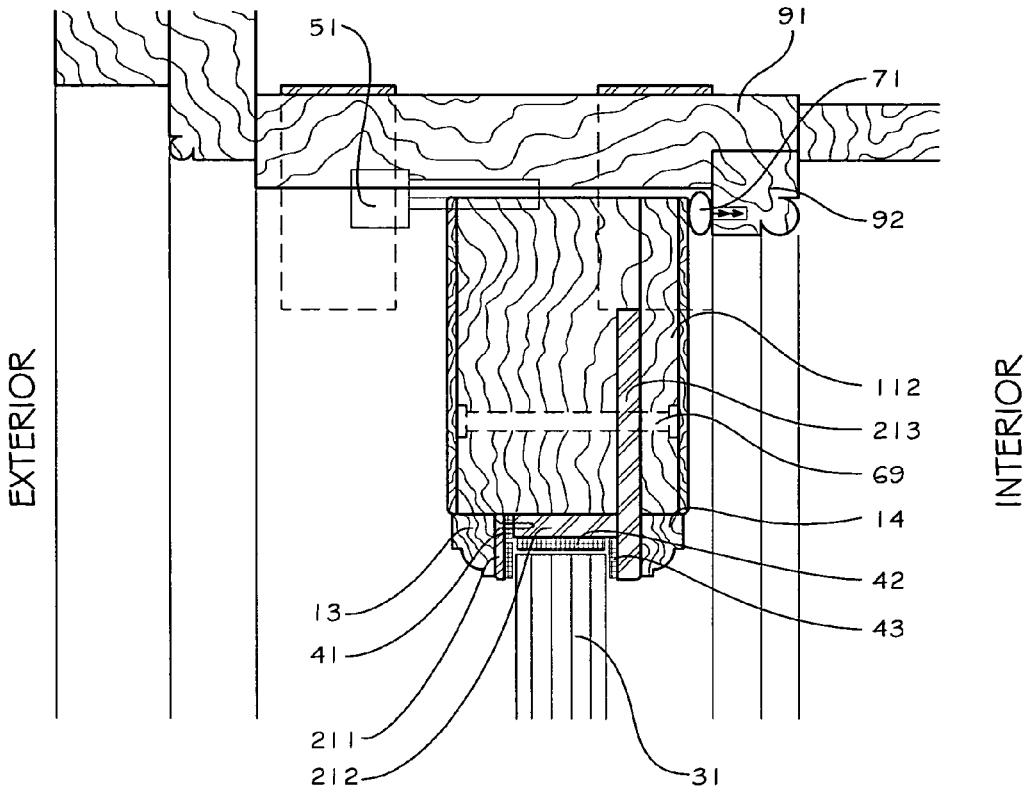
FIG. 15 is an alternate embodiment of FIG. 7 showing a threshold assembly detail in a cross-sectional side view of the top rail area of the security door.

As shown in FIG. 15, the top rail shows the laminated glass panes 31 covered by a sheet of polycarbonate on the interior side and held in position within the wood interior layer abutting the steel panel, nested within the steel divider and optionally covered by a glaze tape 43 or thermal block material.

Figure 16:
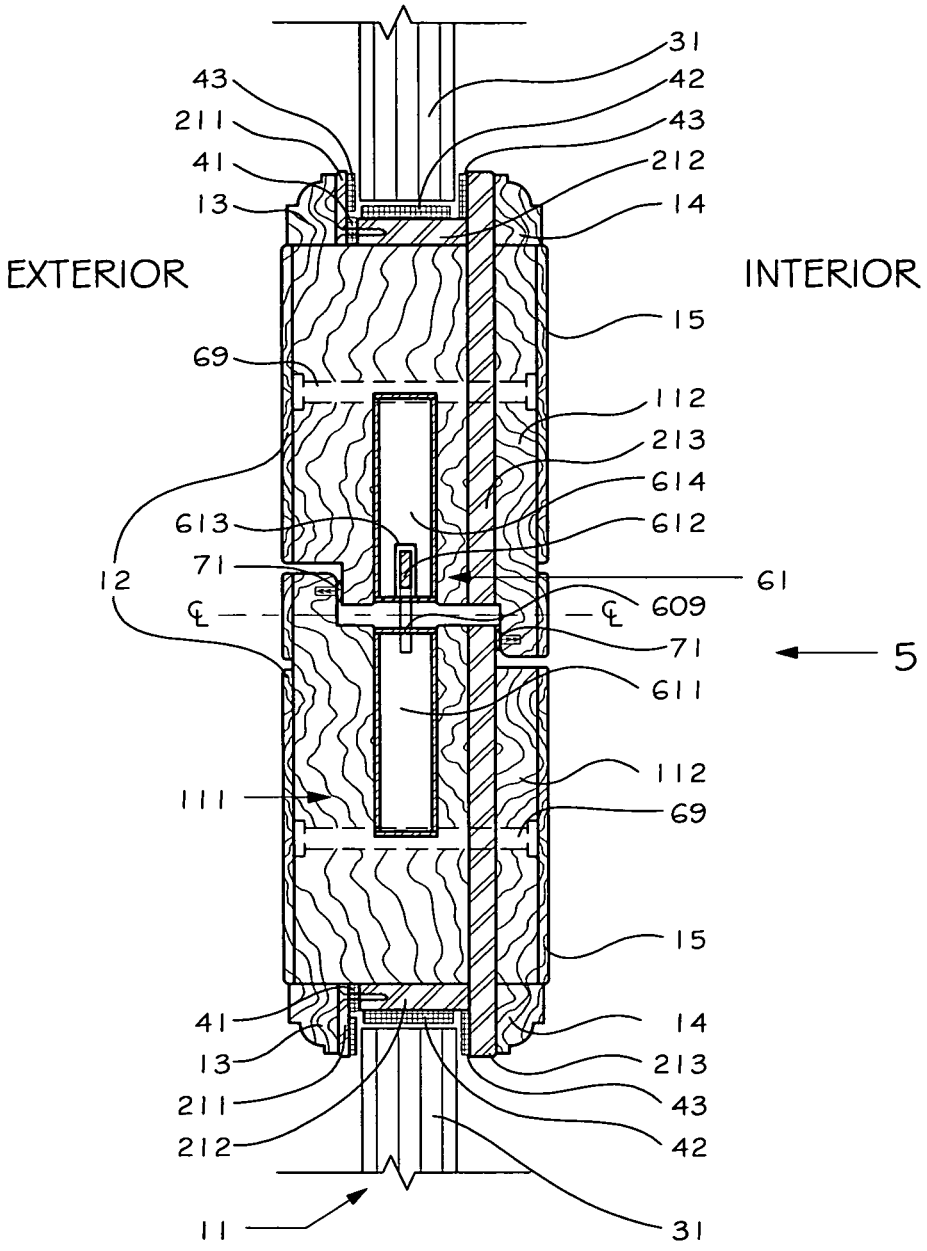
FIG. 16 is an alternate embodiment of FIG. 8 showing the threshold in an overhead cross-sectional view at the half-lap meeting stile area of the top portions of the two doors looking downward.

FIG. 16 shows the half lap meeting stile details similar to that shown in FIG. 8.

Figure 9:
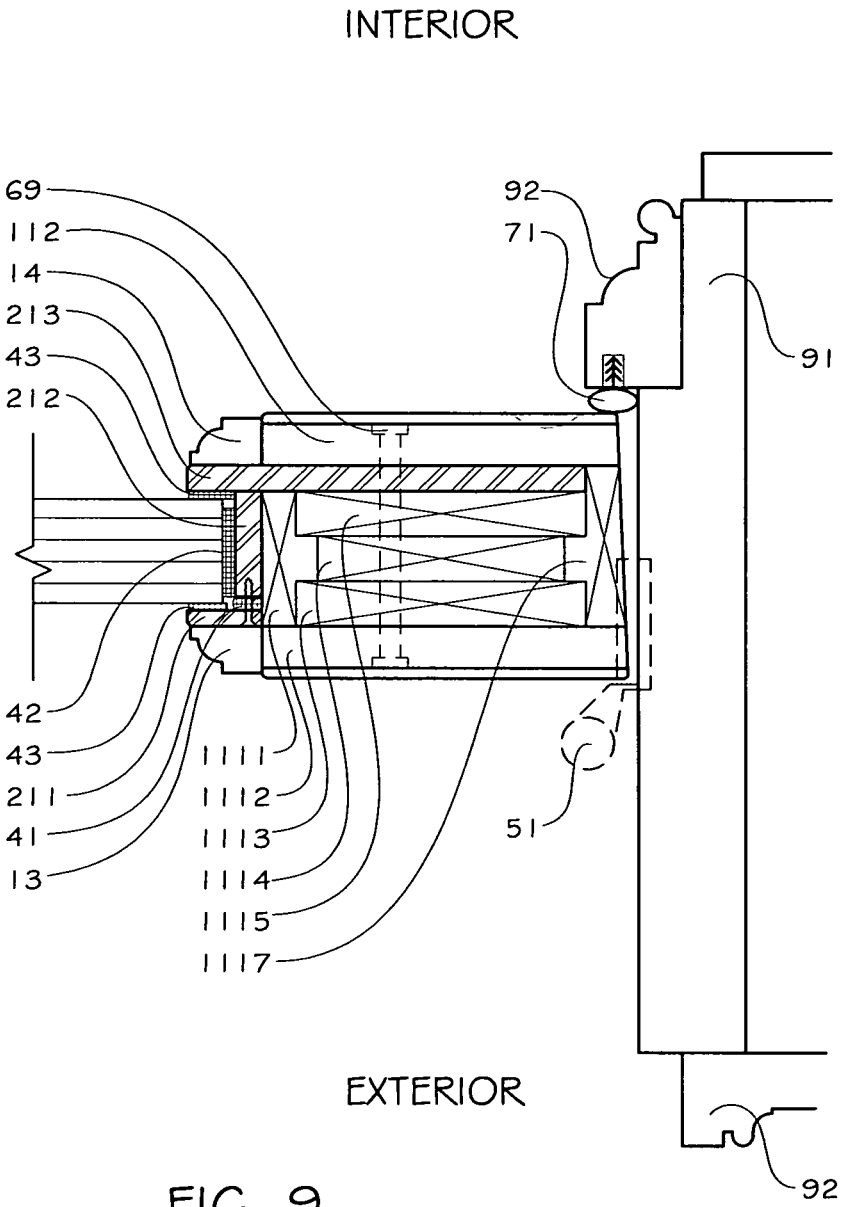
FIG. 9 is a overhead cross-sectional view of the jamb area of the security door as shown in FIG. 3 looking downward.
Figure 17:
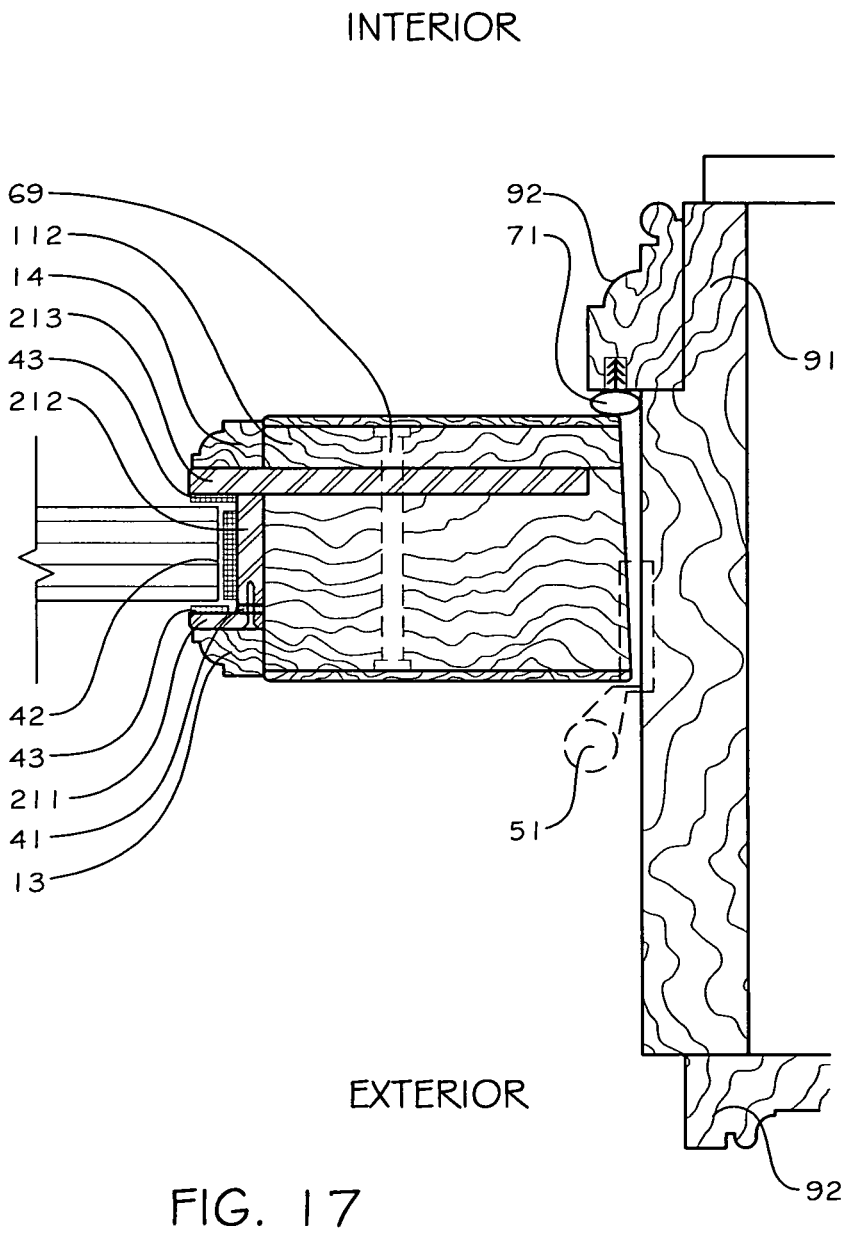
FIG. 17 is an alternate embodiment of FIG. 9 showing an overhead cross-sectional view of the jamb area of the security door as shown in FIG. 3 looking downward.

FIG. 17 shows a jamb detail embodiment similar to FIG. 9 showing an overhead cross-sectional view of the jamb area of the security door looking downward.

Figure 18:
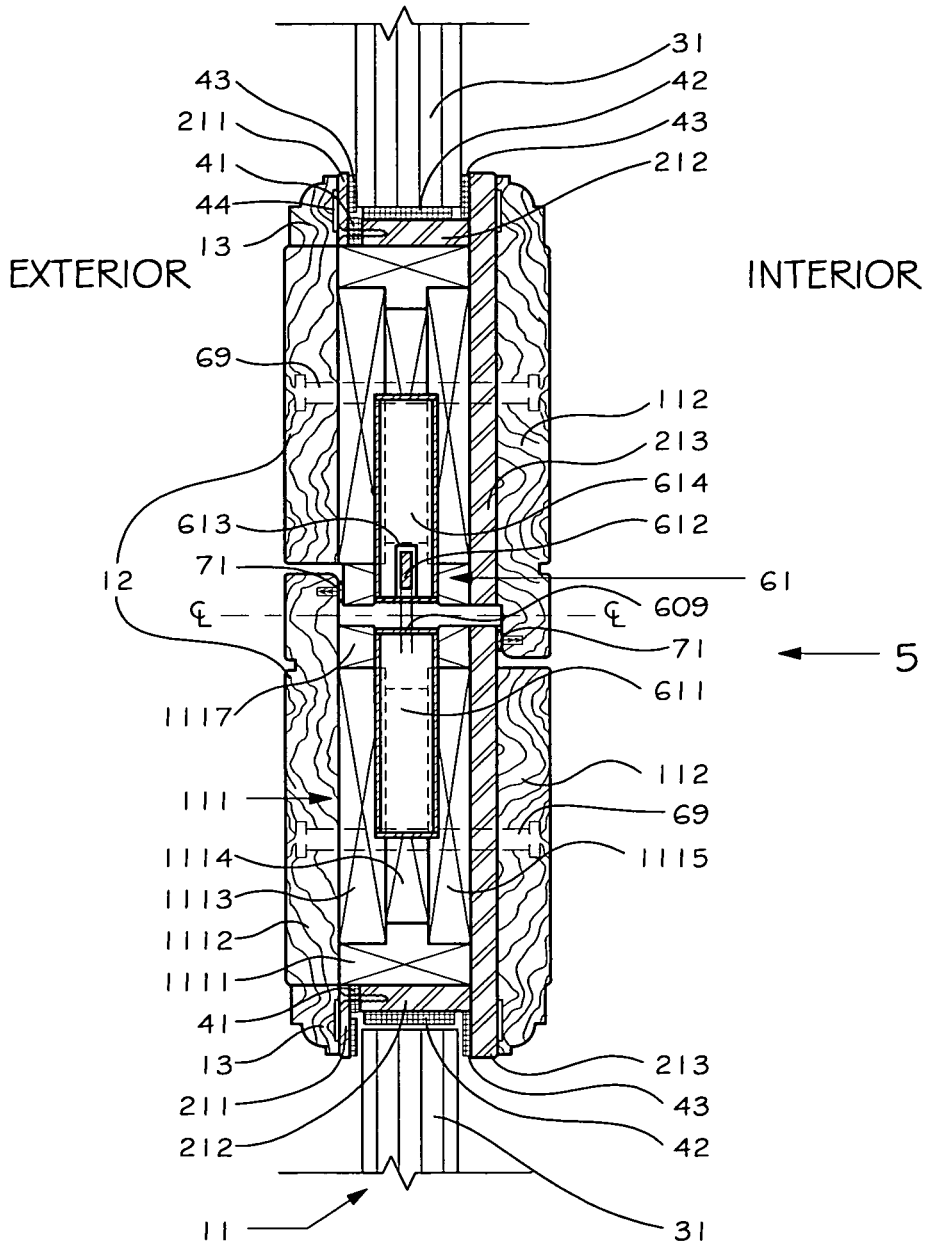
FIG. 18 is an alternate embodiment showing the assembly detail of in an overhead cross-sectional view at the half-lap meeting stile area of the top portions of the two doors looking downward.
Figure 19:
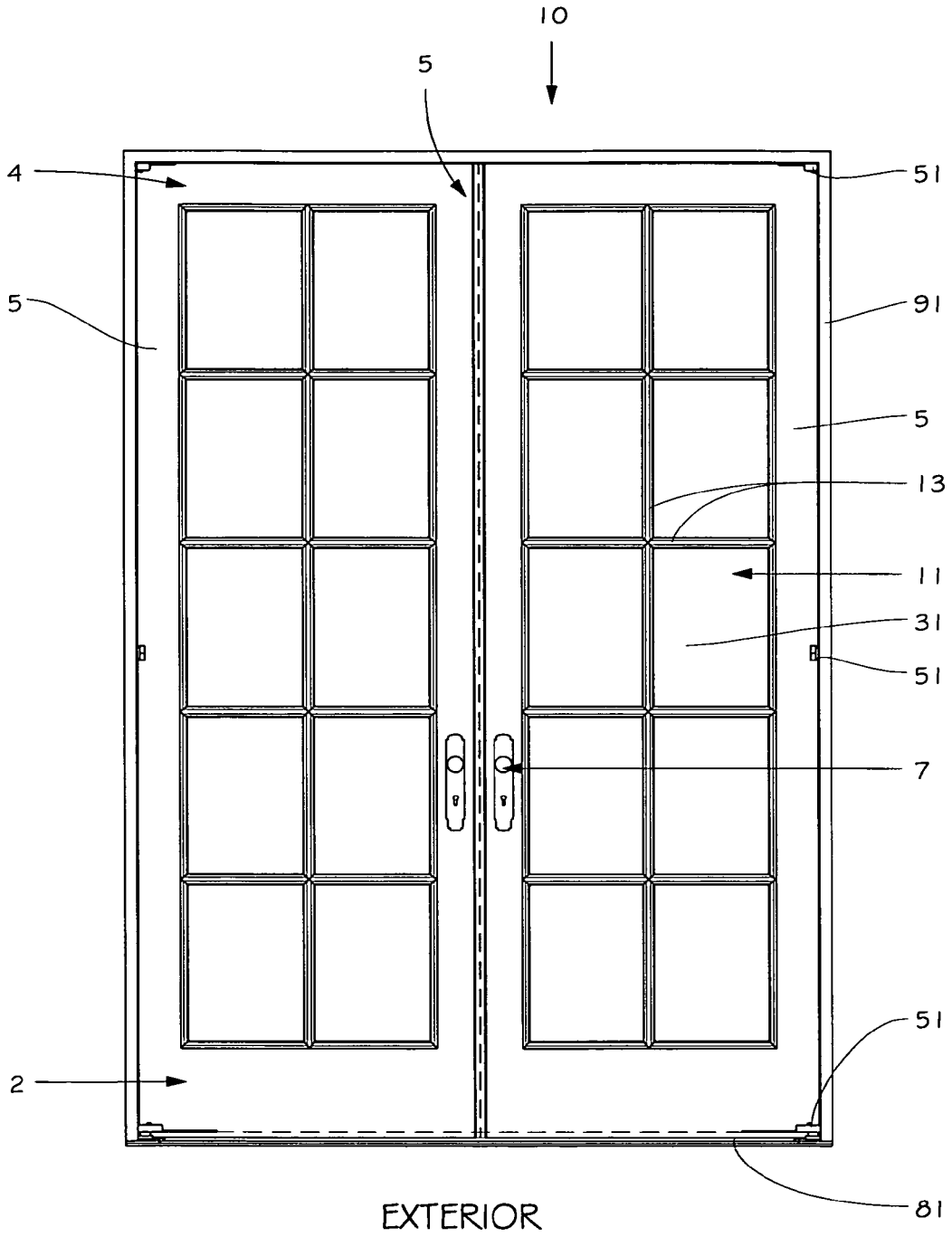
FIG. 19 is a front elevated view of a stile and rail ballistic security door of the present invention.
Figure 20:
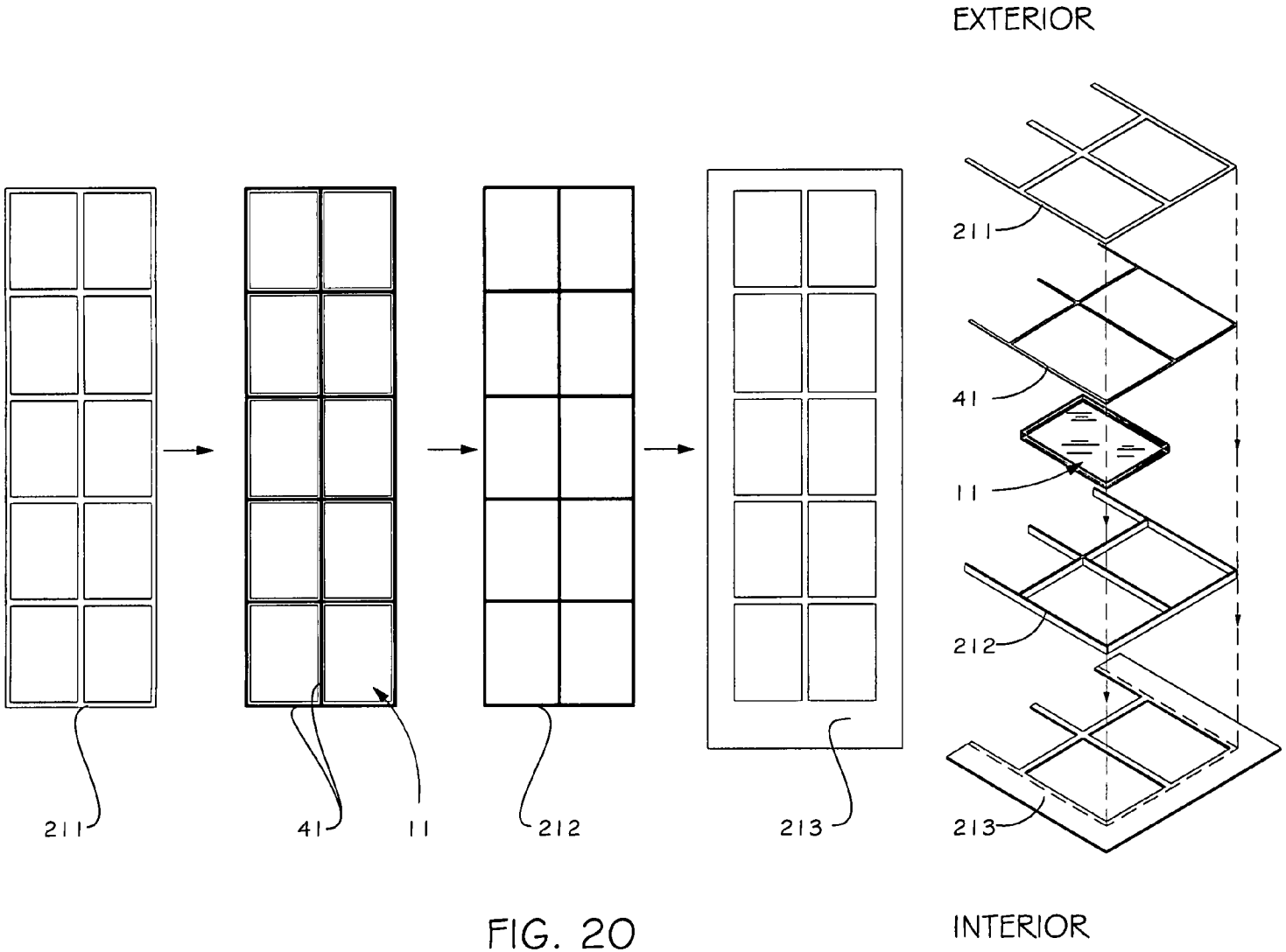
FIG. 20 is an order of assembly axon showing the security door steel components wherein the steel grill dividers are welded onto the steel plate and the steel plate grid covers the plate glass assembly disposed therebetween.

FIG. 18 is an alternate embodiment showing the assembly detail of in an overhead cross-sectional view at the half-lap meeting stile area of the top portions of the two doors looking downward;

FIG. 19 is a front elevated view of a stile and rail ballistic security door of the present invention; and FIG. 20 is an order of assembly axon showing the security door steel components wherein the steel grill dividers are welded onto the steel plate and the steel plate grid covers the plate glass assembly disposed therebetween.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. A security door and frame assembly, comprising:

a frame comprising structural members selected from the group consisting of steel, metal, stainless steel, copper, bronze, aluminum, titanium, wood, graphite polymer, graphene polymer, high density polyethylene polymers, nylon, and combinations thereof; and a door comprising:

a) a multi-layer exterior core comprising flat frame members including an exterior muntin divide, an exterior veneer, and exterior wood core, and an exterior steel core flat grid;

b) a panel comprising strips of thermal break material;

c) an interior bullet proof grid plate comprising at least one bullet resistant transparent or translucent pane comprising a glass or a synthetic material;

d) a window pane divider grid; and e) a multi-layer interior core comprising a steel core interior flat plate, an interior wood core, an interior veneer, and an interior muntin divide;

said multi-layer exterior core flat frame members bonding to one another comprising two vertical and two horizontal bands connecting together forming a rectangular band including a first T-shaped cavity defining an outer marginal edge of said rectangular band, a second T-shaped cavity defining an inner marginal edge of said rectangular band, a first T-shaped rectangular band being bonded into and around said first T-shaped cavity, and a second T-shaped rectangular band being bonded into and around said second T-shaped cavity.

2. The security door and frame assembly of claim 1 including thermal break material preventing condensation between said glass and said exterior steel grid comprising a strip of insulating material disposed between said glass and said exterior steel grid selected from the group consisting of a glazing tape, a two sided adhesive polyvinyl chloride material, a neoprene material, a closed cell foam glazing tape, and combinations thereof.

3. A security door and frame assembly, comprising:

a frame comprising structural members selected from the group consisting of steel, metal, stainless steel, copper, bronze, aluminum, titanium, wood, graphite polymer, graphene polymer, high density polyethylene polymers, nylon, and combinations thereof;

a door comprising:

a) a multi-layer exterior core comprising flat frame members including an exterior muntin divide, an exterior veneer, and exterior wood core, and an exterior steel core flat grid;

b) a panel comprising a thermal break material;

c) an interior bullet proof grid plate comprising at least one bullet resistant transparent or translucent pane comprising a glass or a synthetic material;

d) a window pane divider grid; and e) a multi-layer interior core comprising a steel core interior flat plate, an interior wood core, an interior veneer, and an interior muntin divide.

4. The security door and frame assembly of claim 3 wherein said panel of thermal break material preventing condensation between said glass and said exterior steel core flat grid comprises a strip of insulating material disposed between said glass and said exterior steel core flat grid selected from the group consisting of a glazing tape, a two sided adhesive polyvinyl chloride material, a neoprene material, a closed cell foam glazing tape, and combinations thereof.

5. The security door and frame assembly of claim 3 wherein said thermal break material is a nonconducting thermal break material disposed between said exterior steel core flat grid and around an outside edge of a plurality of glass panes sealing said plurality of glass panes against an steel divider panel and steel interior flat plate against temperature variations which can cause condensation problems.

6. A security door comprising:

a) a multi-layer exterior core comprising flat frame members including an exterior muntin divide, an exterior veneer, and exterior wood core, and an exterior steel core grid;

b) a panel comprising strips of a nonconducting thermal break material;

c) an interior bullet proof grid plate comprising at least one bullet resistant transparent or translucent pane comprising a glass or a synthetic material;

d) a steel window pane divider grid; and e) a multi-layer interior core comprising a steel core interior flat plate, an interior wood core, an interior veneer, and an interior muntin divide.

7. The security door of claim 6 wherein said panel of thermal break material preventing condensation between said at least one bullet resistant transparent or translucent pane and said exterior steel core grid comprises a strip of insulating material disposed between said at least one bullet resistant transparent or translucent pane and said exterior steel core grid selected from the group consisting of a glazing tape, a two sided adhesive polyvinyl chloride material, a neoprene material, a closed cell foam glazing tape, and combinations thereof.

8. The security door of claim 6 wherein said thermal break material is a nonconducting thermal break material disposed between said exterior steel core grid and around an outside edge of at least one bullet resistant transparent or translucent pane sealing said at least one bullet resistant transparent or translucent pane against an steel divider panel and steel interior plate against temperature variations which can cause condensation problems.

* * * * *